US005388380A

United States Patent [19]

Niese

[11] Patent Number: 5,388,380

[45] Date of Patent: Feb. 14, 1995

[54] ANCHORED/RESILIENT SLEEPER FOR HARDWOOD FLOOR SYSTEM

[75] Inventor: Michael W. Niese, Cincinnati, Ohio

[73] Assignee: Robbins, Inc., Cincinnati, Ohio

[21] Appl. No.: 912,310

[22] Filed: Jul. 13, 1992

[51] Int. Cl.[6] ..... E04B 5/52

[52] U.S. Cl. ..... 52/480; 52/508; 52/403.1

[58] Field of Search ..... 52/508, 480, 403, 393, 52/346, 481, 479

[56] References Cited

U.S. PATENT DOCUMENTS

| | | | |
|---|---|---|---|
| 26,239 | 7/1867 | Rockabrand et al. . | |
| 194,580 | 7/1877 | Clark . | |
| 1,195,289 | 8/1916 | Stevens . | |
| 1,302,578 | 5/1919 | Murphy . | |
| 1,339,425 | 5/1920 | Stevens . | |
| 1,343,234 | 6/1920 | Stevens . | |
| 1,491,198 | 4/1924 | Cassidy . | |
| 1,610,578 | 12/1926 | Murphy . | |
| 1,672,255 | 6/1928 | Gorman . | |
| 1,693,655 | 12/1928 | Murphy . | |
| 1,781,117 | 11/1930 | Mackie et al. . | |
| 1,787,067 | 1/1929 | Eisler . | |
| 1,977,496 | 10/1934 | Snyder et al. . | |
| 2,035,902 | 11/1934 | Leod . | |
| 2,115,238 | 4/1938 | Stevens . | |
| 2,116,654 | 5/1938 | Barge . | |
| 2,743,487 | 5/1956 | Kuhlman . | |
| 2,823,427 | 2/1958 | Kuhlman . | |
| 2,862,255 | 12/1958 | Nelson . | |
| 3,045,294 | 7/1962 | Livezey, Jr. . | |
| 3,271,916 | 9/1966 | Omholt . | |
| 3,473,281 | 10/1969 | Omholt . | |
| 3,511,001 | 5/1970 | Morgan, Jr. . | |
| 3,562,990 | 2/1971 | Boettcher . | |
| 3,604,173 | 9/1971 | Rune . | |
| 3,803,791 | 4/1974 | Turnbull et al. . | |
| 4,325,546 | 4/1982 | McMahon et al. | 52/480 |
| 4,449,342 | 5/1984 | Abendroth . | |
| 4,589,243 | 5/1986 | Abendroth . | |
| 4,648,592 | 3/1987 | Harinishi . | |
| 4,653,246 | 3/1987 | Hepler . | |
| 4,759,164 | 7/1988 | Abendroth et al. | 52/480 |
| 4,819,932 | 4/1989 | Trotter, Jr. | 52/480 |
| 4,856,250 | 8/1989 | Gronau et al. | 52/480 |
| 4,856,250 | 8/1989 | Gronau et al. . | |
| 4,860,516 | 8/1989 | Koller et al. | 52/480 |
| 4,862,664 | 9/1989 | Romine . | |
| 4,884,932 | 12/1989 | Meyer . | |
| 4,890,434 | 1/1990 | Niese | 52/480 |
| 4,930,280 | 6/1990 | Abendroth | 52/480 |
| 5,016,413 | 5/1991 | Counihan . | |

FOREIGN PATENT DOCUMENTS

| | | |
|---|---|---|
| 180712 | 1/1955 | Australia . |
| 579217 | 7/1959 | Canada . |
| 53863 | 11/1937 | Denmark . |
| 106748 | 12/1899 | Germany . |
| 46074 | 3/1965 | Germany . |
| 2150566 | 4/1973 | Germany . |
| 6409901 | 3/1965 | Netherlands . |
| 18671 | 2/1899 | Switzerland . |
| 175933 | 4/1934 | Switzerland . |
| 24053 | of 1907 | United Kingdom . |

OTHER PUBLICATIONS

Silence is Golden, Stevens System of Sound and Vibration Control.

*Primary Examiner*—Carl D. Friedman
*Assistant Examiner*—Wynn E. Wood
*Attorney, Agent, or Firm*—Wood, Herron & Evans

[57] ABSTRACT

An anchored/resilient floor system includes at least one upper flooring layer supported by spaced, parallel rows of attachment strips which are supported above a base by a plurality of compressible pads, the attachment strips being secured to the base at spaced, predetermined positions therealong in a manner which permits downward deflection under loaded conditions but prevents vertical raising of the strips beyond their initial static position. Moreover, the attachment strips are anchored in a manner which does not hold the pads in a precompressed state when the floor is unloaded. Several fastening arrangements provide for anchoring of the attachment strips with these features, including a pin/sleeve construction, a wrapped mesh construction, an angled clip construction and a transverse band construction.

23 Claims, 3 Drawing Sheets

ANCHORED/RESILIENT SLEEPER FOR HARDWOOD FLOOR SYSTEM

FIELD OF THE INVENTION

This invention relates to hardwood floor systems. More particularly, this invention relates to an anchored and resilient sleeper for a hardwood floor system.

BACKGROUND OF THE INVENTION

Floor systems, particularly hardwood floor systems, are commonly supported by sleepers. Sleepers are elongated nailing strips, often of wood, laid end to end in spaced, parallel rows. A layer of hardwood floor boards or another type of wear layer is then secured to the sleepers for additional dimensional stability. If desired, one or more intermediate layers may be used between the wear layer and the sleepers. The sleepers support the other floor components in spaced relation above a base.

One recognized advantage of supporting a floor system with sleepers relates to moisture susceptibility. The components of most floor systems are made of wood. Humidity changes from season to season cause wooden components of floor systems to expand with moisture ontake and contract with moisture expulsion. Because sleepers support other components in spaced relation above the base, the sleepers limit moisture transfer between the base and these other components. Moreover, the free space between the supported components and the base enables air to circulate therebetween to minimize moisture transfer.

Because moisture-caused expansion and contraction of wooden floor system components, including the sleepers, may result in buckling or vertical raising, it is desirable to securely anchor the floor system to the base below. To prevent this vertical raising, the sleepers must be anchored. Anchoring of the sleepers provides an acceptable level of dimensional stability for the floor system, compared to free floating-type floor systems in which the sleepers are not anchored.

It is also desirable for hardwood floor systems to provide a degree of resilience. In the context of this application, resilience generally means the ability of a floor system to absorb shock upon impact and to deflect downwardly upon impact. Although other factors must be considered in determining the overall resiliency of a floor system, the capability for absorbing shock and deflecting downward are the most critical. Particularly for hardwood floors used in athletic contests, the resilience of the floor plays a major role in reducing the incidence of athletic injury. In short, if a floor provides some degree of give, the stress placed upon the musculoskeletal structure of the athlete is reduced.

It is common practice to provide resiliency for a floor system by locating compressible pads below the sleepers. The compressibility of the pad enables the sleepers and the floorboards thereabove to deflect downwardly. The amount of downward deflection and the shock absorption of the floor system will depend upon a number of factors, including the shape and composition of the pads.

Recent studies indicate that, while resiliency is important to the reduction of susceptibility to athletic injury, uniformity in resiliency is also critical. Thus, it is desirable to provide a floor system with a degree of resiliency which is uniform throughout its surface area.

Unfortunately, it has proved difficult to achieve dimensional stability, optimum resiliency and uniformity in resiliency for hardwood floors supported by sleepers. The enhancing of one of these features commonly adversely affects the others. For instance, when sleepers are supported above the base by a plurality of compressible pads and the sleepers are fastened to the base, direct fastening of the sleeper produces some initial compression, or precompression of the pads. The pads remain compressed throughout the life of the floor, even when the floor is unloaded. Because of this already compressed state, the capability of the pads for further deflection is inhibited, and the overall resiliency of the floor system is greatly reduced. On the other hand, if the floor system is free-floating, i.e. the sleepers are not anchored securely to the base, the entire floor system may be dimensionally unstable.

While some commercially available floor systems have achieved a degree of success in addressing one or more of these concerns, such floor systems tend to have a relatively high cost, due to an increase in the number or complexity of structural components required for achieving these features and the increased costs associated with shipping and installing these components. As a result, the benefits of these floor systems have been limited unnecessarily to a relatively low number of users.

It is an objective of this invention to achieve optimum dimensional stability and optimum resiliency and uniformity of resiliency for a sleeper type hardwood floor system.

It is another objective of this invention to substantially improve resiliency and dimensional stability for a relatively low cost, sleeper type hardwood floor system.

It is still another objective of this invention to enhance the dimensional stability of a sleeper-type hardwood floor system without producing a corresponding loss in resiliency, or uniformity in resiliency.

The objectives of this invention are achieved by a sleeper construction which utilizes an attachment or nailing strip supported by compressible pads above a base and a fastening arrangement which secures the sleepers directly to the base without interacting with the pads. This fastening arrangement enables the attachment strips to deflect downwardly upon impact to upper floor layers but restricts upward raising of the nailing strips beyond the initial static position of the pads. More importantly, this fastening arrangement enables the attachment strips to be anchored to the base in a manner which does not precompress the pads when the floor system is unloaded. Thus, this anchored/resilient sleeper provides optimum dimensional stability and resiliency.

Because the manner of anchoring the attachment strips does not precompress the pads or hold them in a precompressed state, an even distribution of the compressible pads along the attachment strips will assure a uniformly resilient, yet firmly anchored, floor system.

Additionally, because of its simplicity and relatively few number of parts, the embodiments of this invention provide anchoring, resiliency and uniformity in resiliency for a sleeper-type floor system at a low cost. Fabrication and installation of the sleepers is also simplified. Finally, because the fastening arrangement provides secured anchoring, the lengths of the sleepers may be increased. As a result, less waste is produced and shipping, handling and installation costs are reduced.

According to one preferred embodiment of the invention, a fastener/sleeve construction is utilized. With this embodiment, each attachment or nailing strip has at least one vertical bore extending from an upper surface to a lower surface thereof. At least two compressible pads are secured to the lower surface. The vertical bore includes an enlarged-diameter upper portion and a reduced-diameter lower portion. The sleeve resides within the lower, reduced-diameter portion, with the bottom edge of the sleeve contacting the base and the top edge of the sleeve residing adjacent the upper portion of the bore. A washer resides on top of the sleeve. Alternately, the sleeve may include an upper flange. A fastener extends downwardly through the washer, or flange, through the sleeve and into the base. An enlarged head at the top of the fastening pin engages and holds the washer, or the flange, against the bottom surface of the upper portion.

This securely holds the sleeve and the nailing strip to the base. Because the outer diameter of the sleeve is less than the diameter of the reduced-diameter lower portion of the bore, upon impact from above, the nailing strip may deflect downwardly unimpeded by the sleeve. The combined vertical dimension of the sleeve and the washer, or flange, is equal to the combined vertical dimension of the pad and the lower portions of the bores. Thus, the sleeve provides a solid line of rigid material between its top end and the base, so that downward driving forces applied via the fastening pin do not precompress the pads.

Preferably, the vertical dimension between the top of the fastening pin and the upper surface of the sleeper is greater than the maximum compression of the pads. This ensures that, upon downward deflection of the nailing strips, the fastening pin will not project above the upper surface of the nailing strip and contact an above-subfloor or floorboard layer.

To produce this sleeper, the nailing strips are cut to a desired length. The bores are then cut vertically through the nailing strips from the upper surface to the lower surface. Thereafter, the compressible pads are secured to the lower surface of the nailing strip. The number of pads and bores will depend upon the lengths of the nailing strips and the desired orientation. With the bores cut and the pads secured, the sleepers are ready for shipping to the job site. Alternately, if desired, these two steps may be performed at the job site.

To install the sleeper, multiple sleepers are laid end to end in spaced, parallel rows. Alternatively, every other sleeper in each row may be offset laterally. The sleeves and washers, or sleeves with flanges, are then placed within the bores. Fastening pins are then driven through the sleeves or through the sleeve and washer and into the base below. When fully extended, the head ends of the fastening pins engage either the top surfaces of the washers or the top surfaces of the flanges, depending upon which embodiment is used. The heads of the fastening pins hold the washer or flanges downwardly against the bottom surfaces of the nailing strips which define the enlarged-diameter upper portions of the base.

Because the sleeve and washer, or the sleeve with the flange, does not compress vertically during installation, the sleeve bears all the vertical force placed upon the nailing strip during installation. As a result, driving of the fasteners into the base does not vertically compress the pads. Moreover, after installation, when the floor system is unloaded, the pads are not held in a compressed state. Accordingly, after installation, the compressible pads retain their full compressive capability, thereby providing optimum resiliency potential throughout the floor system.

The upper flooring layers are then secured to the tops of the nailing strips. According to one preferred construction, a subfloor of panels is secured to the sleepers, and then tongue-and-groove maple floorboards are secured to the panels. Because of the combination of anchored and resilient sleepers, along with a subfloor layer of panels, this particular floor construction provides resiliency with a high degree of uniformity throughout its entire surface area. As indicated previously, recent studies suggest that, in addition to resiliency, uniformity of resiliency also plays a critical role in reducing athletic injury on athletic floor systems and enhancing performance.

Alternatively, the floorboards may be secured directly to the nailing strips. As still another alternative, if desired, the upper flooring layer may comprise one or more wood or non-wooden layers, depending upon the primary commercial use of the floor system.

Because of the relatively few number of parts and simple construction, this inventive sleeper provides conventional stability, resiliency and uniformity in resiliency for a hardwood floor system at a relatively low cost, compared to prior anchored and resilient sleeper-type floor systems.

According to alternative fastening arrangements, the attachment strips may be held with wrapped mesh steel secured to the base, with angled clips or with a transverse band. These embodiments are described in further detail in the detailed description.

These and other features of the invention will be more readily understood in view of the following detailed description and the drawings.

DETAILED DESCRIPTION OF THE DRAWINGS

Figure 1:
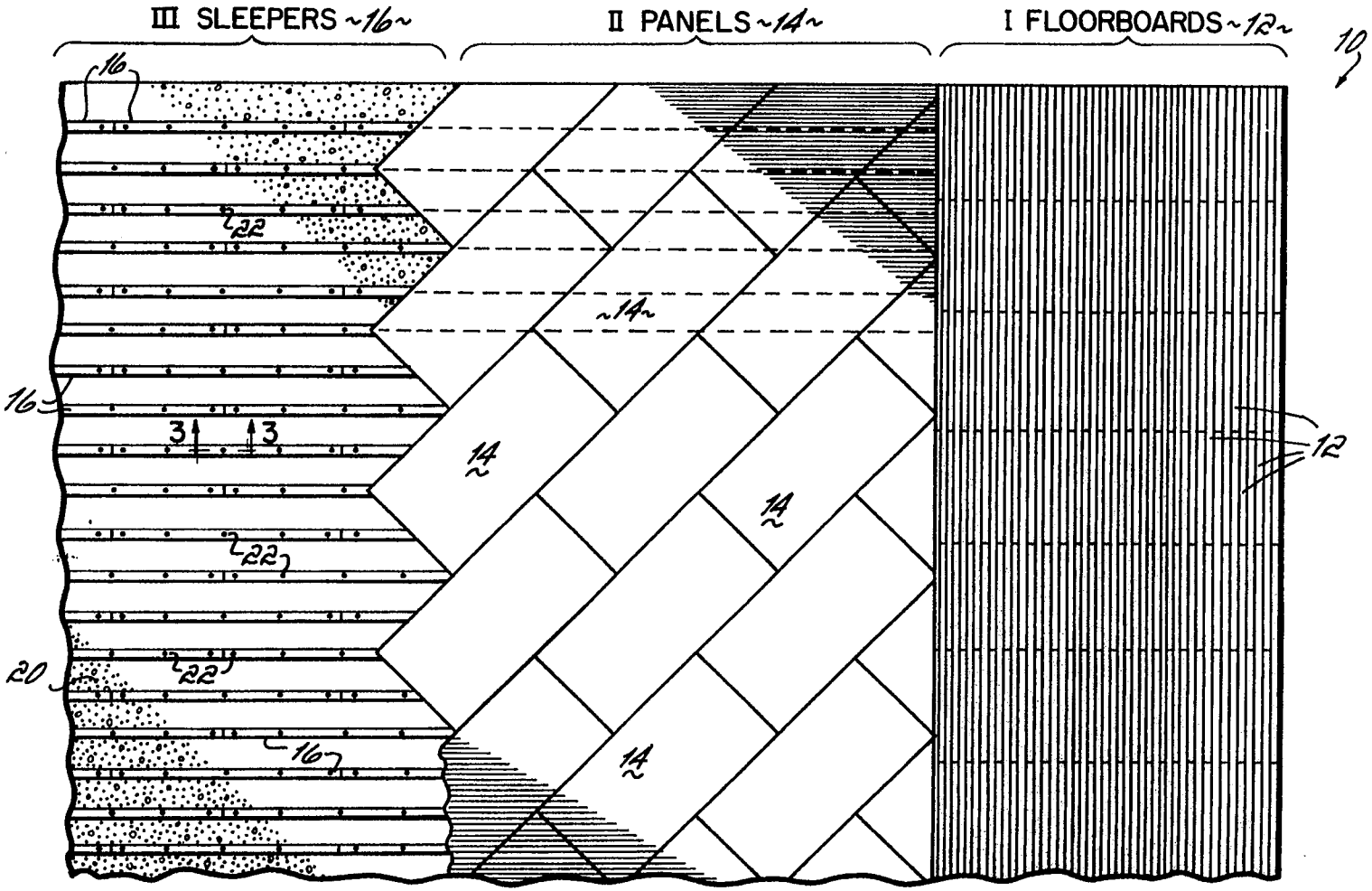
FIG. 1 is a plan view which illustrates a hardwood floor system according to a preferred embodiment of the invention.

FIG. 1 is a plan view which depicts, in section, a hardwood floor system 10 in accordance with a preferred embodiment of the invention. The floor system 10 includes a plurality of floorboards 12 (Section I), a subfloor of panels 14 underlying and supporting the floorboards 12 (Section II), a plurality of nailing or attachment strips 16 laid end to end in spaced, parallel rows to supporting the nailing strips 16 above a base 20

(Section III). The sleeper construction of this invention generally includes the pads 18, the nailing strips 16 and the structural components which anchor the nailing strips 16 to the base 20.

Typically, for athletic floors, the floorboards 12 are tongue and groove maple floorboards, as is well known in the industry. If desired, the floorboards 12 may have kerfs in their bottom surfaces. Kerfing the floorboards 12 provides breaks or discontinuities in the floor system 10 which will effect the impact response frequency. The floorboards 12 are secured by nails (as in FIG. 3) to the subfloor 14. The subfloor 14 is preferably formed from a plurality of 4'×8' plywood panels having a uniform thickness of about ½ inch. The nailing strips 16 are preferably wood, with cross sectional height and width dimensions of about 1½" and 2½", and a length of either 4 feet or 8 feet. In the past, the spacing for the parallel rows of the nailing strips 16 has been about 12".

Figure 2:
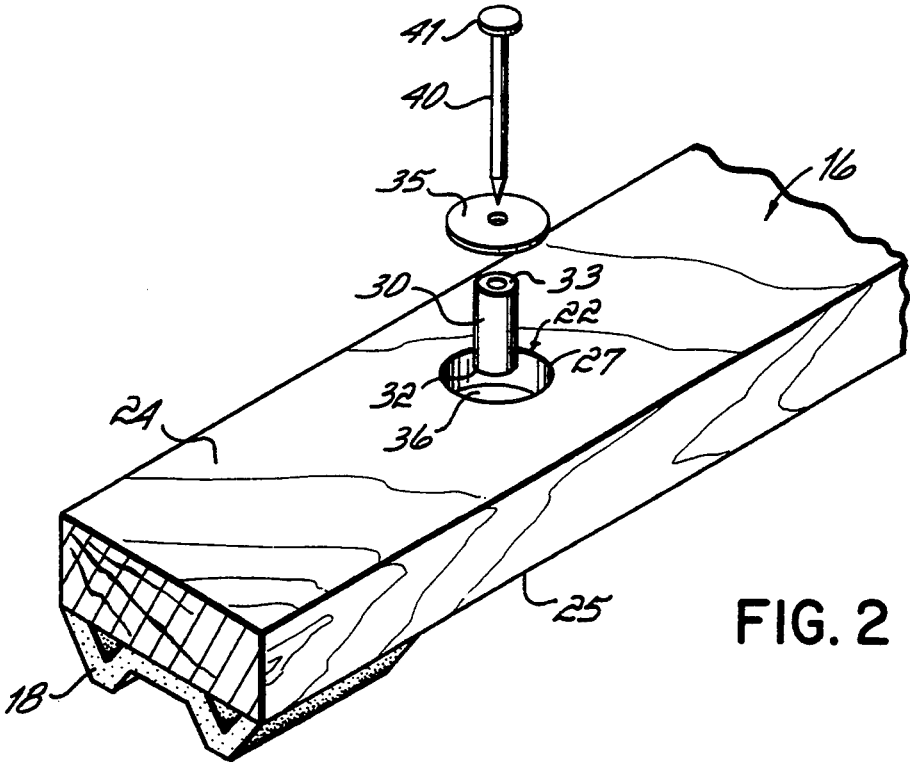
FIG. 2 is a disassembled perspective showing the anchoring means for an anchored resilient sleeper in accordance with one embodiment of the invention.

According to one aspect of the invention, the lengths of the nailing strips 16 may be increased to about 8' and the spacing between the rows of nailing strips 16 may be increased to about 15" to 17". The pads 18 shown in FIGS. 1 and 2 are described in applicant's co-pending application, U.S. Ser. No. 857,232, filed on Mar. 25, 1992, and entitled "Prefabricated Sleeper For Anchored and Resilient Hardwood Floor System". However, it is also to be understood that the advantageous features of this invention could be achieved with any one of a number of pad types, as long as the pads 18 support the nailing strips 16 in spaced relation above base 20, and so long as the pads 18 are compressible.

The primary feature of the invention relates to anchoring the nailing strips 16 to the base 20 in a manner which permits downward deflection and prevents vertical raising but does not substantially precompress the pads 18 during unloaded conditions. Because the nailing strips 16 are downwardly deflectable but not vertically raisable, the floorboards 12 and the subfloor 14, or any alternative upper flooring layer supported by the nailing strips 16, are also downwardly deflectable but not vertically raisable.

Figure 3:
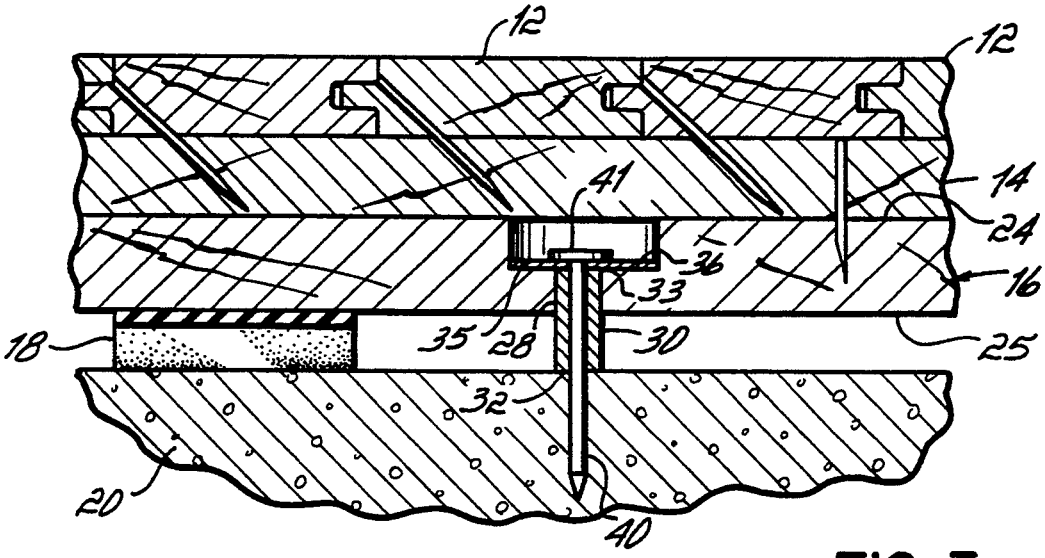
FIG. 3 is a cross sectional view taken along lines 3—3 of FIG. 1.

To accomplish these features, each nailing strip 16 has at least one bore 22 extending vertically therethrough from an upper surface 24 to a lower surface 25, as shown in FIG. 2 and FIG. 3. Each bore 22 has an enlarged-diameter upper portion 27 and a reduced-diameter lower portion 28. Upper portion 27 has a preferable diameter of about 1⅛", and lower portion 28 has a preferable diameter of ⅝". Preferably, the vertical dimension of the upper portion 28 is about ½"– ¾", and the vertical dimension of the lower portion is about ¾"–1". Preferably, the bores 22 are spaced laterally away from the pads 18, though this is not critical or necessary.

For a nailing strip 16 which is 4' long, it is preferable to have two bores 22, with the nailing strip 16 supported by five pads spaced equidistantly along the entire length of the nailing strip 16. With a nailing strip which is 8' in length, it is preferable to utilize three bores 22, with nine pads spaced equidistantly along the length of the nailing strip 16. However, it is also to be understood that the number of bores 22 and/or pads 18 may be varied and reoriented, depending upon the use of the floor system 10 and the structural composition of the upper floor layer or layers.

To anchor the nailing strips 16 to the base 20, a sleeve 30 is located within the reduced-diameter lower portion 28 of each of the bores 22. The sleeve 30 has a bottom edge 32 which contacts the base 20 and a top edge 33 located adjacent the enlarged-diameter upper portion 27. The outer diameter of the sleeve 30 is preferably about 9/16", so that the nailing strip 16 may deflect downwardly without frictionly engaging the sleeve 30. A washer 35 rests upon the top edge 33 of the sleeve 30. The washer 35 is coaxial with the sleeve 30, and a peripheral portion of the washer 35 rests upon a horizontal surface 36 of the nailing strip 16 which defines the bottom of upper portion 27. The washer 35 has an inner diameter which is less than the diameter of the sleeve 30 and greater than the diameter of the anchor pin 40.

Figure 4:
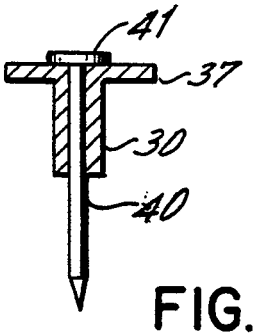
FIG. 4 is a partial elevational view which depicts a variation of the embodiment of the invention shown in FIGS. 1–4.

Alternatively, as shown in FIG. 4, the sleeve 30 includes an integrally-formed upper flange 37 at the top end thereof. The combined vertical dimension of the sleeve 30 with the flange 37, or the sleeve 30 and the washer 35, is substantially equal to the combined vertical dimension of the pad 18 and the lower portion 28.

For either embodiment, a fastening pin 40 extends downwardly through sleeve 30 and into the base 20, as shown in FIG. 3. Pin 40 has an enlarged head 41 at a top end thereof which tightly engages and holds the washer 35, or the sleeve 30 and the flange 37, against surface 36, thereby tightly securing the bottom edge 32 of the sleeve against the base 20. In this position, the head 41 of the pin 40 prevents upward movement of the sleeve 30 and the washer 35, or the flange 37. The pin 40 also cooperates with the washer 35 or the sleeve 30 and the flange 37 to hold the nailing strip 16 in a secured, anchored position with respect to the base 20, so that the nailing strip 16 cannot raise upwardly therefrom. Additionally, due to the relative diameter of the sleeve 30 with respect to lower portion 28, and due to the compressibility of the pads 18, the nailing strips 16 are downwardly deflectable upon impact to the floorboards 12.

Anchoring of the nailing strips 16 with the pin 40 and sleeve 30 combination provides dimensional stability for the nailing strips 16 and the entire floor system 10. The downward deflectability of the nailing strips 16 also provides resiliency for the entire floor system 10. In addition, this invention optimizes the resiliency of the compressible pads that are utilized. Because the interrelationship of the bore 22, the washer 35, the sleeve 30 and the surface 36 results in a manner of anchoring the nailing strips 16 which does not hold the pads 18 in a precompressed state when the floor system 10 is unloaded. Finally, because of the uniform distribution of the pads 18 and the pins 40, the floor system 10 is highly uniform in resilient response characteristics.

To further enhance the ability of the floor system 10 to withstand horizontal movement due to moisture ontake or egress, the diameters of the bores 22 may be oversized with respect to the sleeve 30.

During installation, the sleeve 30 and the washer 35, or the sleeve 30 and the flange 37, bear the downward compressive force applied when the pin 40 is driven vertically downward. The pads 18 are sufficiently isolated from the downward force so that they are not precompressed. As a result, the floor system 10 provides optimum resiliency characteristics for whatever type of compressible pad is used.

To manufacture an anchored/resilient sleeper according to the invention, the nailing strips 16 are cut to the desired height, width and length dimensions. As indicated previously, the nailing strips 16 may be cut in 4', 8' or even 12' lengths. Several benefits are achieved with these longer lengths. The amount of wasted material is reduced, and shipping, handling and installation costs are decreased. The bores 22 are then cut vertically through the nailing strips 16, from upper surface 24 to lower surface 25, and the pads 18 are secured to the lower surface 25. The pads 18 may be adhered by gluing or mechanically fastened by stapling.

At the job site, the nailing strips 16 are laid in spaced, parallel rows, either end-to-end or with staggered ends, with the pads 18 contacting the base 20. Due to the anchored, dimensional stability provided by the pins 40 and the sleeves 30, the spacing between the rows may be increased from the prior commonly used dimension of 12" up to about 15", or even 18" or 24", or possibly higher, if a subfloor layer 14 is also used. As a result of this increased spacing, the cost of the sleepers per unit surface area of the floor is reduced.

With the nailing strips 16 in place, the sleeves 30 are placed within the bores 22. The washers 35 may then be placed on the top edges 33 of the sleeves 30. If sleeves 30 with flanges 37 are used, no washers 35 are necessary. The pins 40 are then extended through the sleeves 30 and driven into the base 20. This latter step may be performed with an automated fastening gun or manually, by drilling and pinning. When driven in, the heads 41 of the pins 40 engage the washers 35, or the flanges 37, thereby causing the washers 35 or flanges 37 to tightly engage the horizontal surfaces 36 and causing the bottom edges 32 of the sleeves 36 to engage the base 20 firmly and anchor the nailing strip 16 to the base 20.

In this position, the washers 35 or flanges 37 prevent vertical raising of the nailing strips 16, and the relative diameters of the sleeves 30 and the lower portions 28, along with the compressibility of the pads 18, enable the nailing strips 16 to deflect downwardly upon impact from above. Moreover, the pads 18 are neither precompressed during installation nor held in a precompressed state as a result of installation. Rather, the pads 18 are held between the nailing strips 16 and the base 20 in a substantially uncompressed state. Thus, the floor system 10 allows optimum resilient performance for the pads 18, regardless of the type of compressible pad used.

After installation of the nailing strips 16, the upper layer of panels 14 is secured thereto. A layer of floorboards 12 is then secured to the subfloor layer 14 of panels. Because the vertical distance between the top of pin 40 and the top of the nailing strip 16 is greater than the maximum vertical compression of the pads 18, the pin 40 cannot contact the bottom of the subfloor 14 when force is applied from above, even under very heavy loads. This prevents "bottoming out" of the floor system upon impact, or interference by the anchor pins 40 with the action of the floor system 10.

Figure 5:
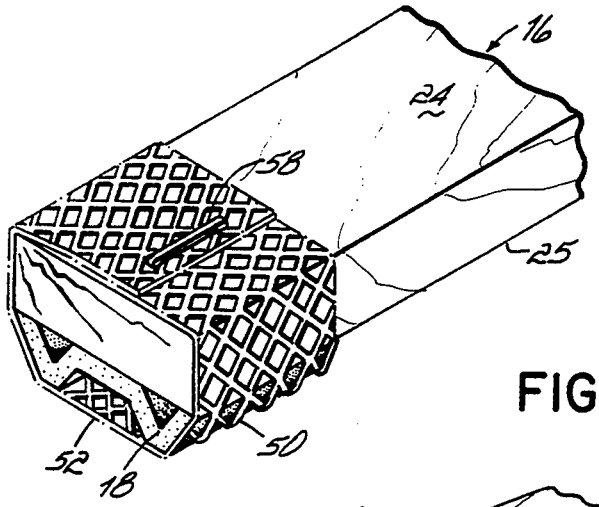
FIG. 5 is a perspective view which depicts one alternative embodiment of the invention.

This invention also contemplates alternative structures and methods for providing a resilient and anchored sleeper supported by compressible pads held in a substantially noncompressed state when unloaded. One such alternative is shown in FIG. 5 and involves the use of predetermined lengths of a semi-rigid, but flexible, member 50, such as mesh, graphite tissue, film glass or wire mesh wrapped around the nailing strips 16 and pads 18.

According to this embodiment, a central portion 52 of each of the lengths 50 of mesh spring steel is adhered or mechanically fastened to the base 20 in an orientation which is perpendicular to the direction of the nailing strips 16. The nailing strip 16 is then laid upon the base 20 with each of the compressible pads 18 supported on a centrally-adhered portion 52 of one of the lengths 50 of mesh spring steel. Opposite ends of the members 50 are then wrapped snugly around the nailing strip 16 and secured in place by one or more nails or staples 58 and/or adhesive driven into the upper surface 24 of the nailing strip 16.

When wrapping the member 50 around the pad 18 and the nailing strip 16, care must be taken to assure that the pads 18 will not be held therebetween in a compressed state. Although the pads 18 may become compressed somewhat during driving of the staples or nails to secure the wrapped ends of the member 50, the pads 18 will be able to rebound immediately thereafter, before the upper floor system components are secured to the nailing strips 16. In short, the pads 18 will allow downward deflectability, and the snugness of the secured members 50 will prevent upward raising, but the pads 18 will not be held in a precompressed state when the floor system 10 is unloaded.

Although this alternative embodiment of the invention has been described with respect to a member 50 of mesh spring steel, it is also to be understood that other flexible, high strength material would also prove suitable.

Figure 6:
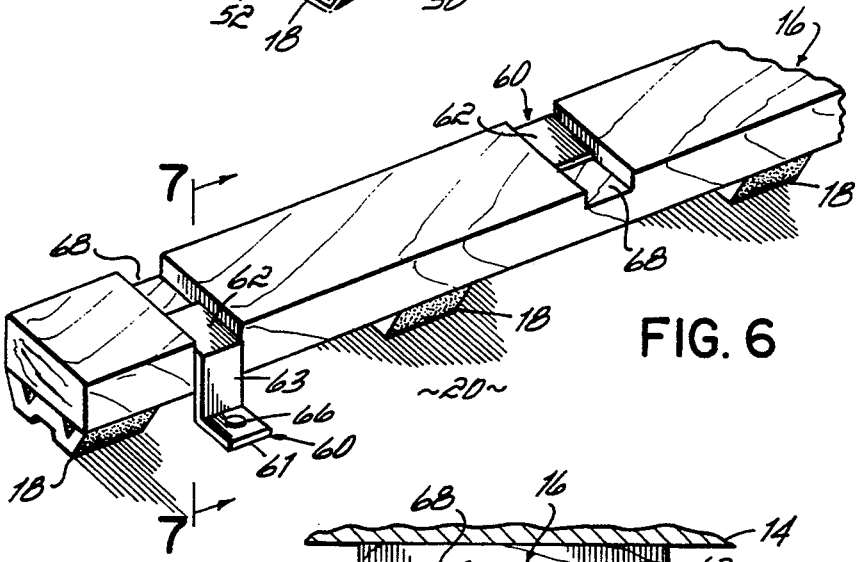
FIG. 6 is a perspective view of which depicts another alternative embodiment of the invention.
Figure 7:
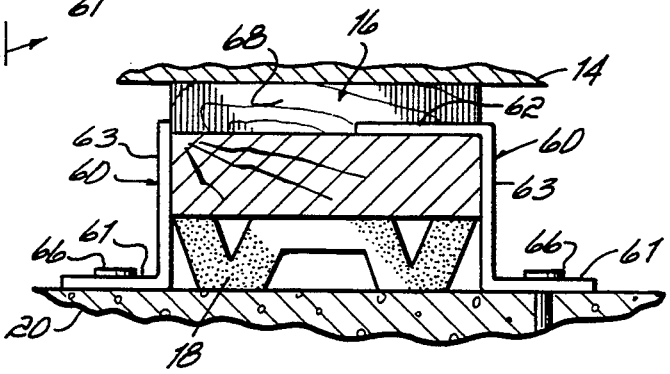
FIG. 7 is a cross-sectional view taken along lines 7—7 of FIG. 6.

According to another embodiment of the invention, as shown in FIGS. 6 and 7, the attachment strips 16 are held to the base 20 by a plurality of spaced clips 60. Each of the clips 60 has a first section 61 spaced from a second section 62, with a rigid section 63 located therebetween. Preferably, first and second sections 61 and 62 are parallel with each other. First section 61 is fastened to the base 20 by a pin 66, or by adhesive. The second section 62 contacts a top surface of the attachment strip 16, but is positioned within a recess or notch 68 in the upper surface 24 of the attachment strip 16. One clip 60 is used for each notch 68. The vertical dimension of the rigid third section 63 is equal to the vertical dimension of the pad 18 plus the vertical dimension of the attachment strip 16 at the notch 68. Preferably, the depth of the notch 68 is greater than the vertical compressibility of the pads 18 so that the floor system 10 will not bottom out under heavy loads. Preferably, as shown in FIG. 6, every other clip 60 is located on an opposite side of the attachment strip 16.

Figure 8:
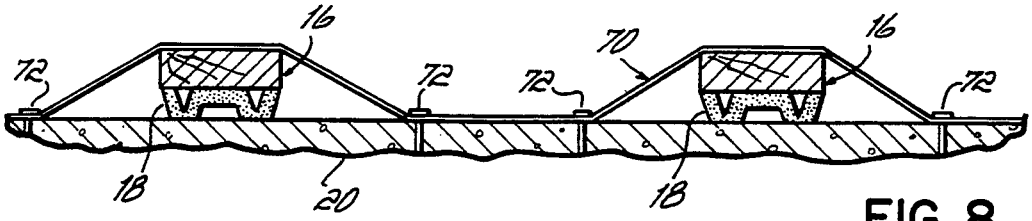
FIG. 8 is a cross-sectional view which depicts still another alternative embodiment of the invention.

According to still another alternative embodiment of the invention, as shown in FIG. 8, the attachment strips 16 are held to the base 20 by a plurality of overlying, transversely oriented bands 70. Preferably, the bands 20 are metal, though other materials would also work. On opposite sides of the attachment strip 16, the bands 70 are fastened to the base 20 by pins 72. The bands 70 are fastened in such a manner that the attachment strips 16 may deflect downwardly upon impact, but are not permitted to raise upwardly beyond the initial static position of the floor system 10.

If desired, the bands may extend all the way across the surface area to be covered by the floor system 10. According to this variation, the bands 70 would extend across the tops of all of the attachment strips 16 of the floor system 10.

For all of the above-described embodiments, the attachment strips 16 are held to the base 20 in a manner which permits downward deflection, but prevents upward movement beyond the initial static position of the pads 18 when the floor system 10 is unloaded. Additionally, for all of the embodiments, the attachment strips 16 are held to the base 20 at spaced, predetermined locations along the lengths thereof, and in a manner which does not result in a holding of the pads 18 in a precompressed condition.

From the above disclosure of the general principles of the present invention and the preceding detailed description of the preferred embodiment, those skilled in the art will readily comprehend the various modifications to which the present invention is susceptible. Therefore, we desire to be limited only by the scope of the following claims and equivalents thereof.

I claim:

1. A floor system covering a base comprising:

an elongated attachment strip with upper and lower surfaces;

at least two compressible pads, the pads having top and bottom surfaces residing in direct contact with the lower surface and the base, respectively, to support the attachment strip in spaced relation above the base; and means for anchoring the attachment strip to the base in a manner which does not hold the pads in a precompressed state when the floor system is unloaded, said anchoring means being located at spaced, discontinuous positions along the attachment strip and enabling said strip to be downwardly deflectable but not upwardly raisable beyond a static position.

2. The floor system of claim 1 wherein the attachment strip has at least one vertically oriented bore extending therethrough from the upper surface to the lower surface, said bore having an enlarged-diameter upper portion and a reduced-diameter lower portion and said anchoring means extends through said bore.

3. The floor system of claim 2 wherein the pads are secured to the lower surface of the attachment strip.

4. The floor system of claim 2 wherein the pads are spaced horizontally away from said bore.

5. The floor system of claim 2 wherein the vertical distance between the top of the anchoring means and the upper surface is greater than the vertical compressibility of the pad.

6. The floor system of claim 2 wherein said anchoring means further comprises:

a sleeve positioned in the lower portion of the bore, the sleeve having a bottom edge contacting the base and a top edge located adjacent the upper portion, the sleeve also having an outer diameter that is less than the diameter of said lower portion to permit unrestricted downward deflection of the attachment strip with respect to the sleeve; and a pin extended through the sleeve and into the base, the pin having an enlarged head at a top end thereof for holding the sleeve and the strip to the base.

7. The floor system of claim 6 wherein said anchoring means further comprises:

means for preventing the pin from pulling through the sleeve.

8. The floor system of claim 7 wherein said preventing means further comprises:

a washer residing between the top edge of the sleeve and the head of the pin.

9. The floor system of claim 7 wherein said preventing means further comprises:

a flange integrally formed with the sleeve, the flange residing beneath the head of the pin.

10. The floor system of claim 1 wherein said anchoring means further comprises:

a notch in the upper surface of the attachment strip;

a clip having spaced first and second sections and a rigid third section therebetween, the first section being secured to the base and the second section engaging the upper surface of the attachment strip inside the notch, the vertical depth of the notch being greater than the maximum vertical compressibility of the pad.

11. The floor system of claim 1 wherein said anchoring means further comprises:

an elongated band oriented substantially perpendicular to and overlying the attachment strip, the band secured to the base and adapted to anchor the attachment strip.

12. An anchored/resilient floor system comprising:

an upper flooring layer;

a plurality of attachment strips arranged in spaced and parallel rows below the upper layer, the attachment strips having upper and lower surfaces;

a plurality of compressible pads located below the attachment strips to support the attachment strips and the upper flooring layer in spaced relation above a base, the pads having top and bottom surfaces residing in direct contact with the lower surfaces of the attachment strips and the base, respectively; and means for anchoring each of the attachment strips to the base in a manner which does not hold the pads in a precompressed state when the floor system is unloaded, said means for anchoring enabling the strips to be downwardly deflectable but not upwardly raisable beyond an initial static position, said anchoring means located at spaced, discontinuous positions along the lengths of each of the attachment strips.

13. The floor system of claim 12 wherein each of the attachment strips has at least one bore extending vertically therethrough, each of the bores having an enlarged-diameter upper portion and a reduced-diameter lower portion, and the anchoring means extends through the bores.

14. The floor system of claim 12 wherein said anchoring means further comprises:

a notch in the upper surface of the attachment strip;

a clip having spaced first and second sections and a rigid third section therebetween, the first section being secured to the base and the second section engaging the upper surface of the attachment strip inside the notch, the vertical depth of the notch being greater than the maximum vertical compressibility of the pad.

15. The floor system of claim 12 wherein said anchoring means further comprises:

an elongated band oriented substantially perpendicular to and overlying the attachment strip, the band secured to the base and adapted to anchor the attachment strip.

16. The floor system of claim 12 wherein the pads are secured to the lower surfaces of the attachment strips.

17. The floor system of claim 12 wherein the pads are spaced horizontally from the anchoring means.

18. The floor system of claim 12 wherein said upper flooring layer comprises a plurality of floorboards having an upper wear surface.

19. The floor system claim 12 wherein said upper flooring layer comprises a subfloor layer of panels.

20. The floor system of claim 19 and further comprising:

a plurality of floorboards secured to the panels.

21. An anchored/resilient hardwood floor system comprising:

an upper layer of floorboards;

a subfloor located below the upper layer;

a plurality of attachment strips arranged in spaced and parallel rows below the subfloor, the attachment strips having upper and lower surfaces;

a plurality of compressible pads located below the attachment strips and supporting the attachment strips, the subfloor and the upper layer in spaced relation above a base, the pads having top and bottom surfaces residing in direct contact with the lower surfaces of the attachment strips and the base, respectively; and means for mechanically fastening the attachment strips to the base in a manner which does not hold the pads in a precompressed state when the floor system is unloaded, said mechanically fastening means permitting downward deflection but preventing vertical raising of the floorboards, the subfloor and the attachment strips beyond an initial static position, the mechanically fastening means located at spaced, discontinuous positions along the lengths of each of the attachment strips.

22. The floor system of claim 21 wherein the rows of nailing strips are spaced at least about fifteen inches apart.

23. The floor system of claim 22 wherein the nailing strips are at least eight feet long.

* * * * *